US007409893B2

(12) United States Patent
Maymon

(10) Patent No.: US 7,409,893 B2
(45) Date of Patent: Aug. 12, 2008

(54) TOOL FOR HOLDING A BOLT

(76) Inventor: Steven K Maymon, 100 Sherwood Ave., Warwick, RI (US) 02888

( * ) Notice: Subject to any disclaimer, the term of this patent is extended or adjusted under 35 U.S.C. 154(b) by 103 days.

(21) Appl. No.: 11/277,632

(22) Filed: Mar. 28, 2006

(65) Prior Publication Data

US 2007/0234853 A1 Oct. 11, 2007

(51) Int. Cl.
*B25B 9/00* (2006.01)

(52) U.S. Cl. ..... 81/13; 81/44; 29/525.11

(58) Field of Classification Search ..... 81/13, 81/44, 3.55; 29/235, 235.5, 239, 525.01, 29/525.11, 525.02; 254/25, 28
See application file for complete search history.

(56) References Cited

U.S. PATENT DOCUMENTS

D46,218 S * 8/1914 Jacobus ..... D8/18
D256,442 S * 8/1980 Martin ..... D10/77
5,495,651 A * 3/1996 Tsuha ..... 29/235
2003/0047040 A1 * 3/2003 Goskesen ..... 81/13

* cited by examiner

*Primary Examiner*—D. S Meislin
(74) *Attorney, Agent, or Firm*—Barlow, Josephs & Holmes, Ltd.

(57) ABSTRACT

A tool for holding a rod having a threaded end, such as a bolt, in an aperture is disclosed. The tool comprises a handle with a knife portion extending from the handle. The knife portion has a first thread engaging edge and a second thread engaging edge that form a notch. The first thread engaging edge and the second thread engaging edge are configured and arranged to engage the threads on a bolt or a threaded rod to temporarily prevent it from being extracted from the aperture.

2 Claims, 6 Drawing Sheets

TOOL FOR HOLDING A BOLT

BACKGROUND OF THE INVENTION

1. Field of the Invention

The present invention relates generally to hand tools, and more particularly to a hand tool configured to temporarily hold a bolt, or threaded rod, securely within a pipe fitting, or other aperture where bolts and threaded rods are used, while the tradesman fastens a nut onto the end of the bolt or threaded rod.

2. Background of the Related Art

In the construction trades, pipes are commonly used to transport and protect or isolate a variety of materials, like water, sewage, and even electrical cables. These pipes come in sections with a variety of diameters and lengths. However, the pipe sections must be connected together in order to form a continuous tube. To form angles and offsets between one section of pipe and another, pipe fittings with the appropriate angle or offset, are interposed between the two sections of pipes and coupled thereto.

In plumbing and heating and ventilation systems, pipe couplings like those manufactured by Victaulic Company and other manufacturers are often used to connect sections of pipe and fittings together. In fire protection applications, such as fire suppressant systems, specialized pipe couplings, like FireLock® Brand pipe couplings, also manufactured by Victaulic Company, are often used.

Generally, pipe couplings include two U-shaped halves with a flange at either end that are fitted together to form a ring. Each flange has an aperture formed thereon that is configured to receive a bolt therethrough. The two bolts fitted through apertures connect the two halves of the pipe coupling together. Nuts threaded onto the ends of the bolts prevent the two halves of the pipe coupling from separating. A rubber or synthetic rubber gasket is also used in conjunction with the pipe coupling to form a water-tight seal at a seam formed between two pipe sections, or fittings or combination thereof.

To couple two sections of pipe together (or a pipe and a fitting, or two fittings), a liberal amount of grease is applied to the gasket and the ends of the pipe sections (or fittings) to help with positioning the gasket and to ensure a good seal is formed between the pipe sections (or fittings) and the pipe coupling. The gasket is positioned on one end of the pipe (or fitting). Next, the ends of the pipe (or fittings) are carefully lined up. If pipes are being coupled together, the pipes are often restrained at this point to prevent movement; however, this is not always the case. The rubber or synthetic rubber gasket is then repositioned over the seam formed between the two sections of pipe.

The tradesman then positions the two halves of the pipe coupling around the pipe sections and over the gasket. Frequently, the tradesman uses a first bolt to loosely connect the two halves of the pipe coupling together. The tradesman then loosely tightens the nut on the first bolt (so that it will not fall off) and inserts the second bolt through the other set of apertures. While squeezing the flanges on unconnected side of the pipe coupling, the tradesman must thread the nut onto the second bolt and tighten it.

This procedure suffers from disadvantages, however. Frequently, the tradesman's hands are covered in grease, making the nuts and bolts slippery and easily dropped and lost. This situation not only leads to construction delays, but also to great frustration of the tradesman. This procedure is further complicated in the case of coupling two fittings together or when coupling a fitting to a section of pipe because the fitting must often be held by the tradesman while attaching the coupling to the fitting and pipe section. In this instance, if the tradesman drops a nut or bolt or has forgotten to keep the requisite wrench to tighten the nuts and bolts on his or her person, the tradesman may have to remove the pipe coupling from the pipe sections and fitting in order to retrieve the dropped part or missing tool. This situation also leads to added fatigue of the tradesman and, consequently, the frequency of mistakes made by the tradesman increases.

In many cases, the tradesman is working in tight quarters where there is little room for his or her hands, which increase the frequency with which nuts and bolts may be dropped and, as a result, the fatigue and frustrations of the tradesman.

These procedures are further complicated by the fact that the tradesman is often working on overhead pipe sections, which ultimately leads to further fatigue of the tradesman as he or she is constantly reaching over his or her head.

Therefore, there is a need for tool to aid the tradesman while installing a pipe coupling. There is also a need for a tool that minimizes the frequency that a tradesman may drop a nut or bolt while installing a pipe coupling. There is also a need for a tool that allows the tradesman to install of a pipe coupling within small confines.

SUMMARY OF THE INVENTION

The present invention solves the problems of the prior art by providing a tool for holding a rod having a threaded end, such as a bolt, in an aperture. In particular, the tool comprises a handle with a knife portion extending from the handle. The knife portion has a first thread engaging edge and a second opposing thread engaging edge that, in effect, form a notch in the knife portion. The first thread engaging edge and the second thread engaging edge are configured and arranged to slidably engage the threads on a bolt or a threaded rod to temporarily prevent it from being extracted from the aperture.

Accordingly, among the objects of the present invention is the provision for a tool temporarily restrain a bolt in an aperture to ease the process of connecting a nut onto the threaded end of the bolt.

Another object of the present invention is the provision for a tool to ease the installation of pipes, fittings and pipe couplings for tradesmen.

Another object of the present invention is the provision for a tool to reduce the fatigue and frustration of tradesmen during installation of pipes, fittings and pipe couplings by reducing the likelihood of dropping nuts.

Yet, another object of the present invention is the provision for a tool to restrain a bolt that can fit into small spaces.

Yet, another object of the present invention is the provision for a tool to restrain a bolt that is disposable.

Another object of the present invention is the provision for a tool to restrain a bolt that will not damage the threads of the bolt.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENTS

Figure 1:
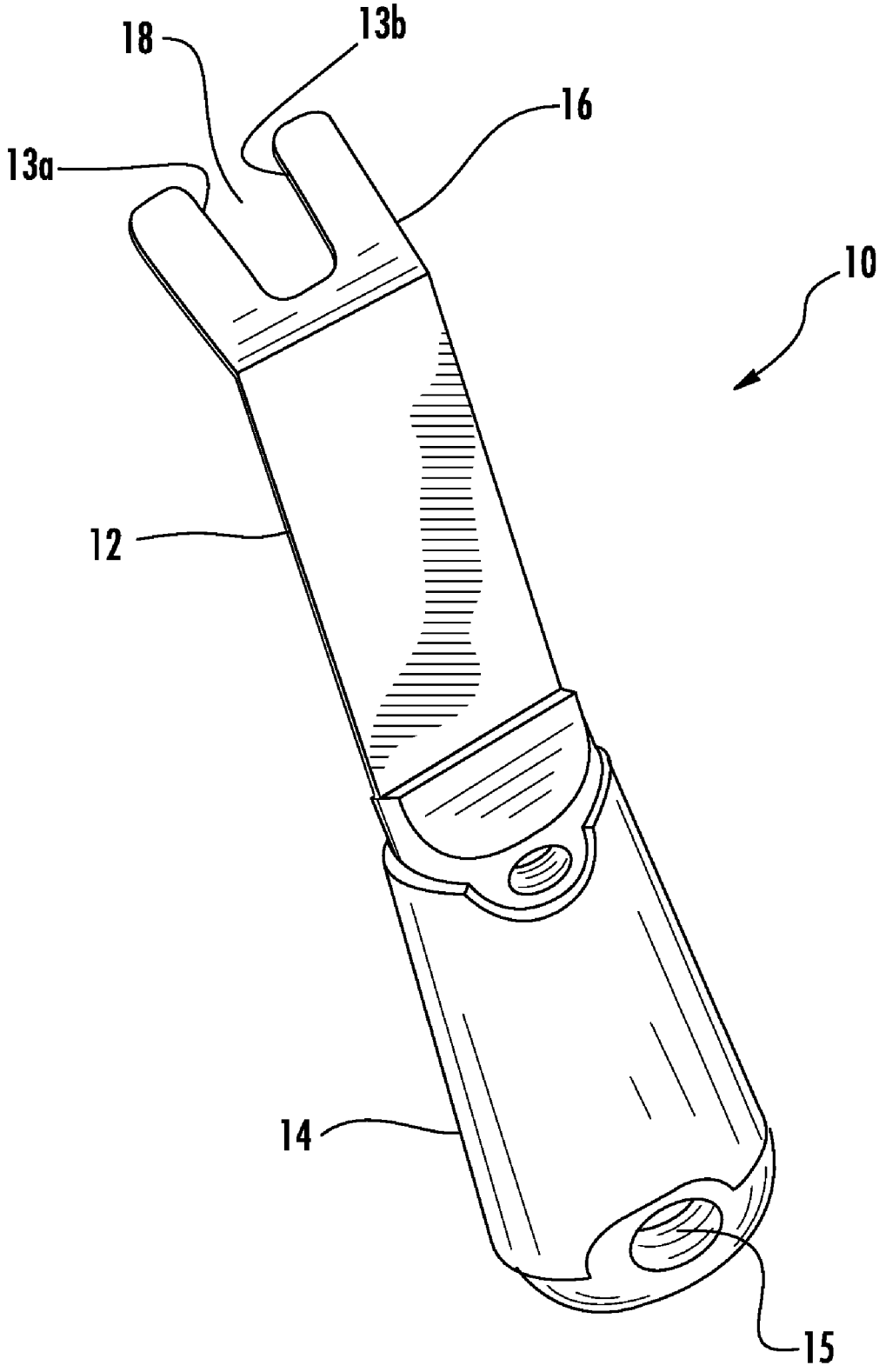
FIG. 1 is a perspective view of the preferred embodiment of the tool of the present invention.

Referring to FIG. 1, the preferred embodiment of the tool of the present invention is shown generally at 10. As will be further described below, the preferred embodiment of the tool 10 of the present invention includes a handle 14 with a flat elongate knife portion 12 extending therefrom. The knife portion has a tip end 16 that has a first thread engaging edge 13*a* and a second opposing thread engaging 13*b* edge that, in effect, form a notch 18 extending inwardly from the tip end 16. The handle 14 optionally includes an aperture 15 for hanging the tool 10 when not in use.

Figure 2A:
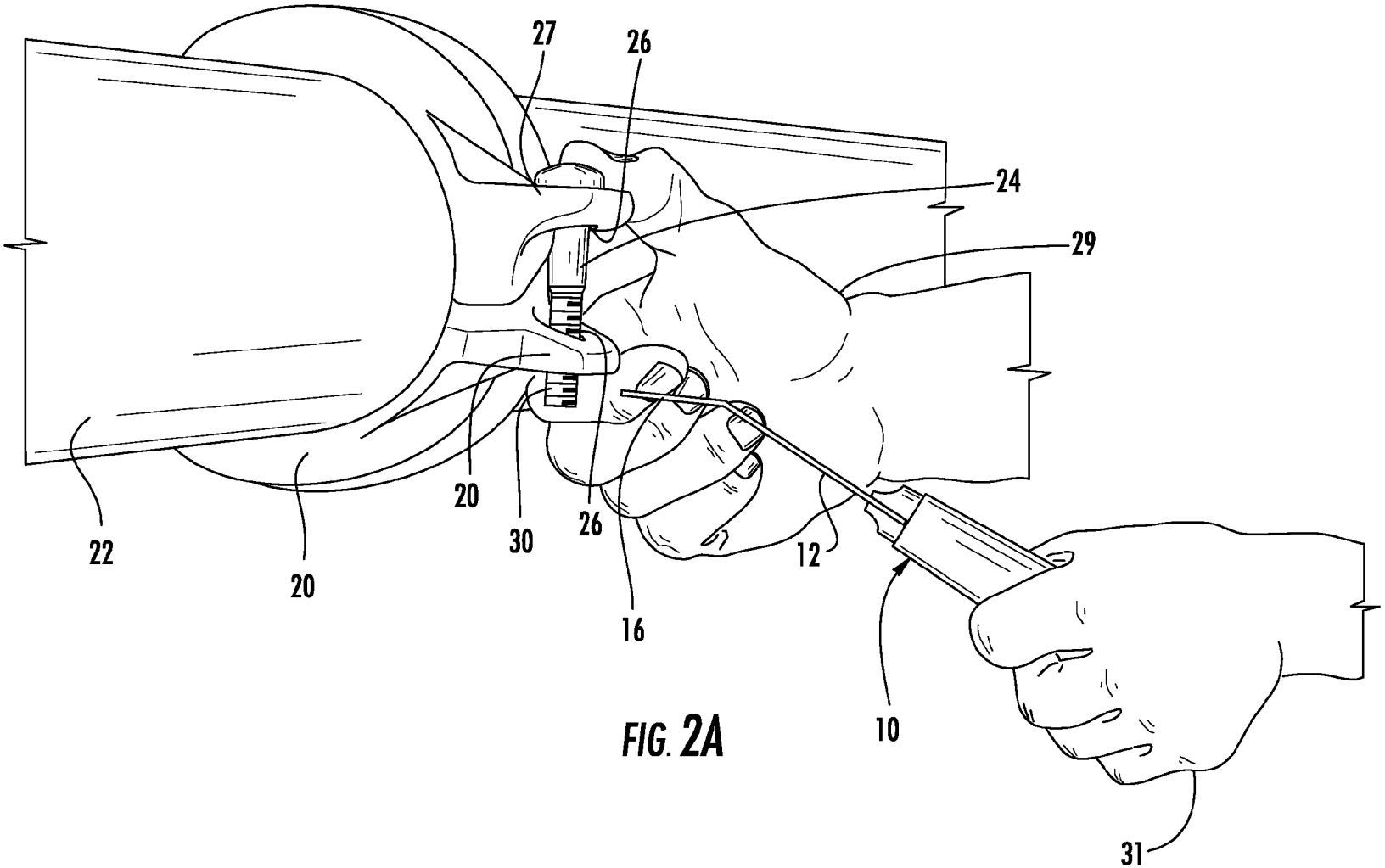
FIG. 2A is a perspective view exemplifying how the tool of the present invention is used to aid the installation of a pipe coupling.
Figure 2B:
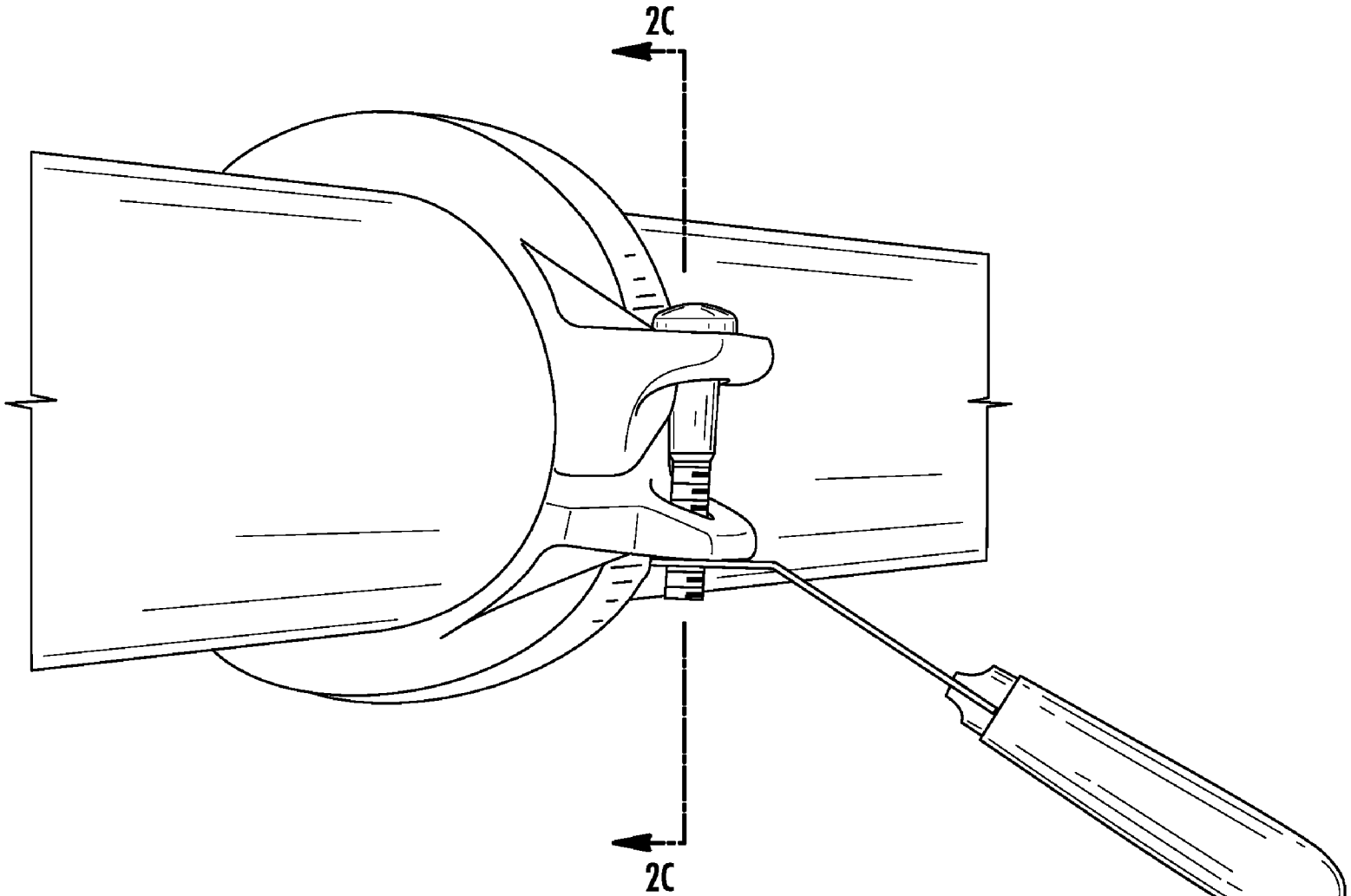
FIG. 2B is a perspective view of the tool of the present invention securely holding the threaded end of a bolt in a pipe coupling.
Figure 2C:
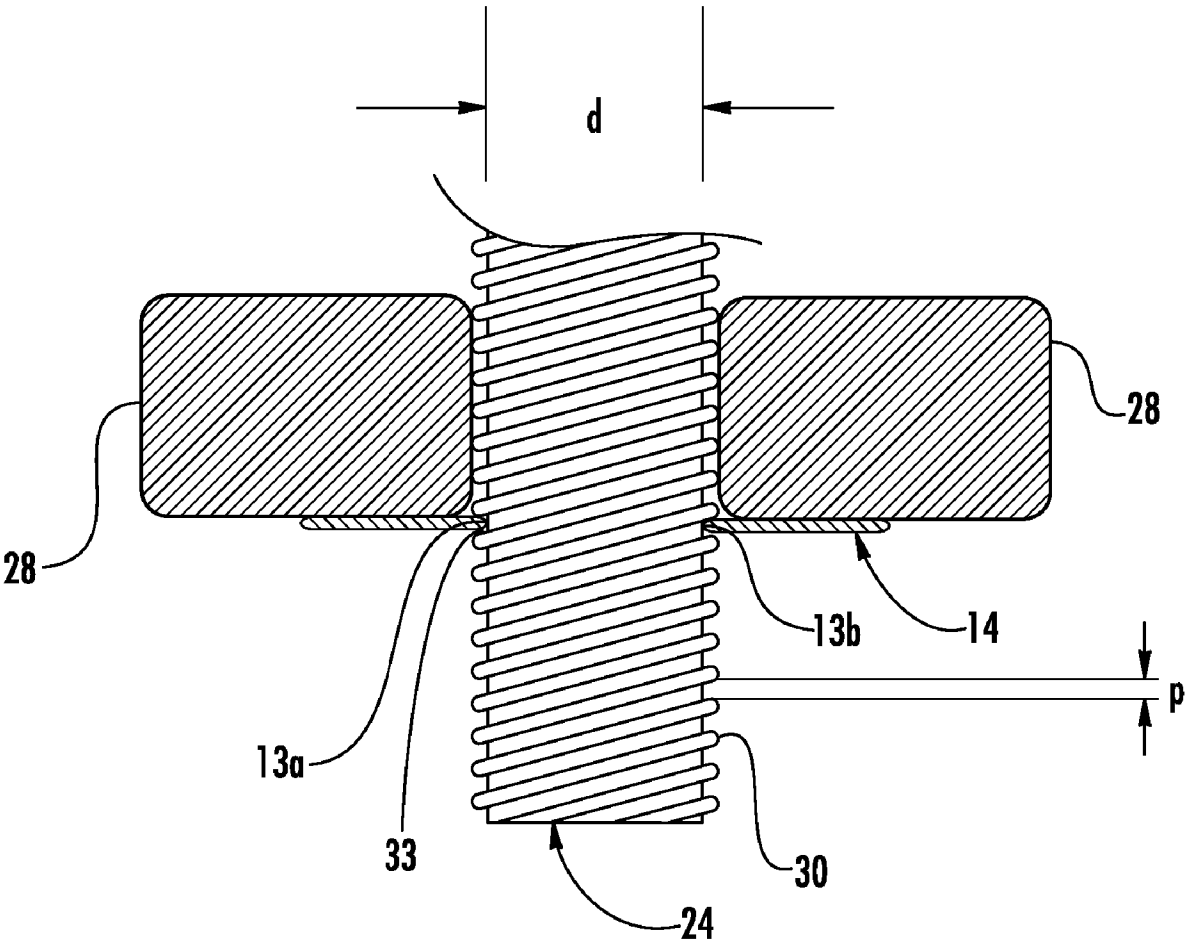
FIG. 2C is a partial cross-section side view through line 2C-2C of FIG. 2B.

As shown in FIG. 2B and 2C, the notch 18 is configured to be slidably received around the shank of a bolt 24 such that the thread engaging edges 13*a*, 13*b*, of the notch 18 becomes wedged between the threads 30 of the bolt 26. In particular, the thread engaging edges 13*a*, 13*b* are configured to be thin enough to fit between the space 33 between the threads 30 of the bolt 24 created by a pitch "p" of the threads 30. The opposing thread engaging edges are also spaced by a distance "d" substantially equal to the width of the shank of the bolt 24. In this regard, the tool 10 may be adapted for use with different size bolts. The knife portion 12 may also be configured to be angled, curved or bent to allow the tradesman to reach into small spaces with the tool 10.

Referring back not to FIG. 2A, to use the tool of the present invention, the tradesman begins installing the pipe coupling 20 on the pipe sections (or fittings) 22 as he or she is accustomed to. However, after the tradesman inserts the second bolt 24 into the apertures 26 on the flanges 27, 28 of the pipe coupling 20 as described above in the background section, he or she instead secures the bolt 24 with the tool 10 of the present invention.

In particular, the tradesman grips the tool 10 by the handle 14 with one hand 29 and maneuvers the tip end 16 of the knife portion 14 towards the exposed threaded end 30 of the bolt 24 protruding from the apertures 26 on the flanges 27, 28 of the pipe coupling 20. While squeezing the flanges 27, 28 of the pipe coupling 20 with the other hand 31, the tradesman slides the notch 18 around the threaded end 30 of the bolt 24 as near to the flange 28 as practical. The first thread engaging edge and the second thread engaging edge on the notch engage the threads of the bolt 24.

Referring to FIG. 2B and 2C, once the notch 18 on the tool 10 is seated against the bolt 24, and the first thread engaging edge and the second thread engaging edge are wedged between the threads of the bolt 24, the tradesman releases the flanges 27, 28 of the pipe coupling 20. The pipe coupling 22 naturally attempts to spring open when released. However, the flange 28 will jam against the tool 10 of the present invention as the thread engaging edges 13*a*, 13*b* of the notch 18 grip the threads 30 of the bolt 24 thereby keeping the pipe coupling 20 temporarily secured around the pipe sections (or fittings) 22.

As can be appreciated, the tradesman can then release the tool 10 thereby freeing both hands 29, 31 so that he or she may secure the nut (not shown) on the threaded end 30 of the bolt 24 with a reduced likelihood of dropping the nut. Even if the tradesman were to drop a nut at this point, he or she may look for it without having to remove the pipe coupling 20 from the pipe or fitting 22. Once the nut is started on the bolt 24, the tradesman can then tighten the nut until it is finger tight on the bolt 24. The tradesman can then pull the tool 10 free from the bolt 20 and finish tightening the nuts onto the bolts 24 to finish securing the pipe coupling 20 to the pipe sections or fittings 22.

Figure 3:
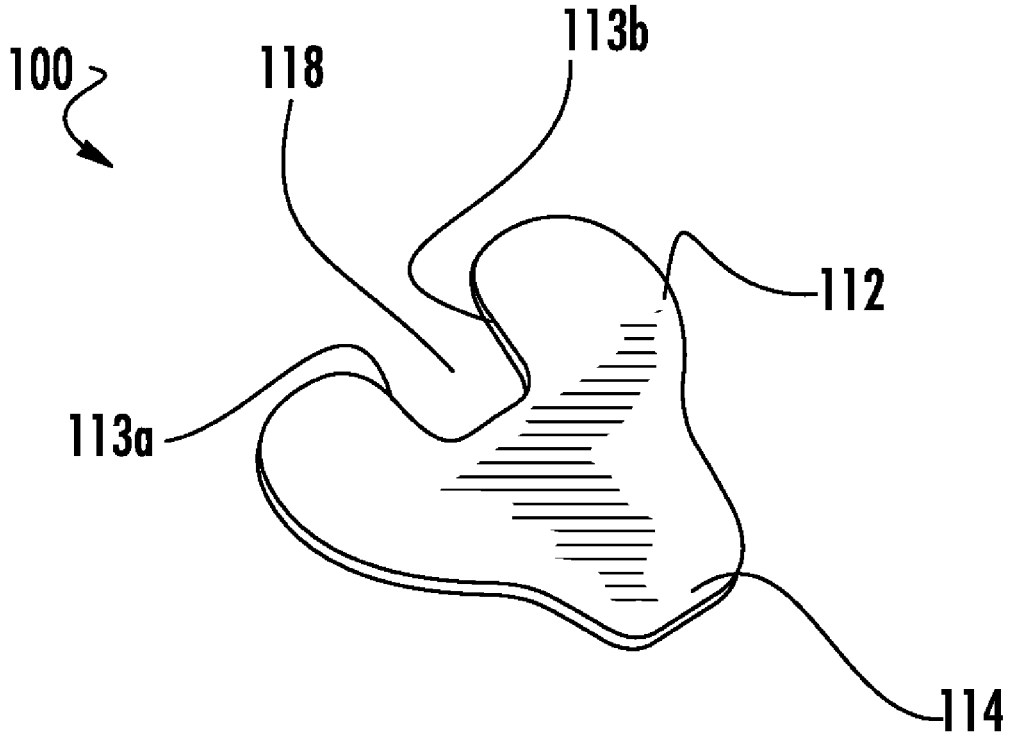
FIG. 3 is a perspective view of an alternative embodiment of the present invention.
Figure 4:
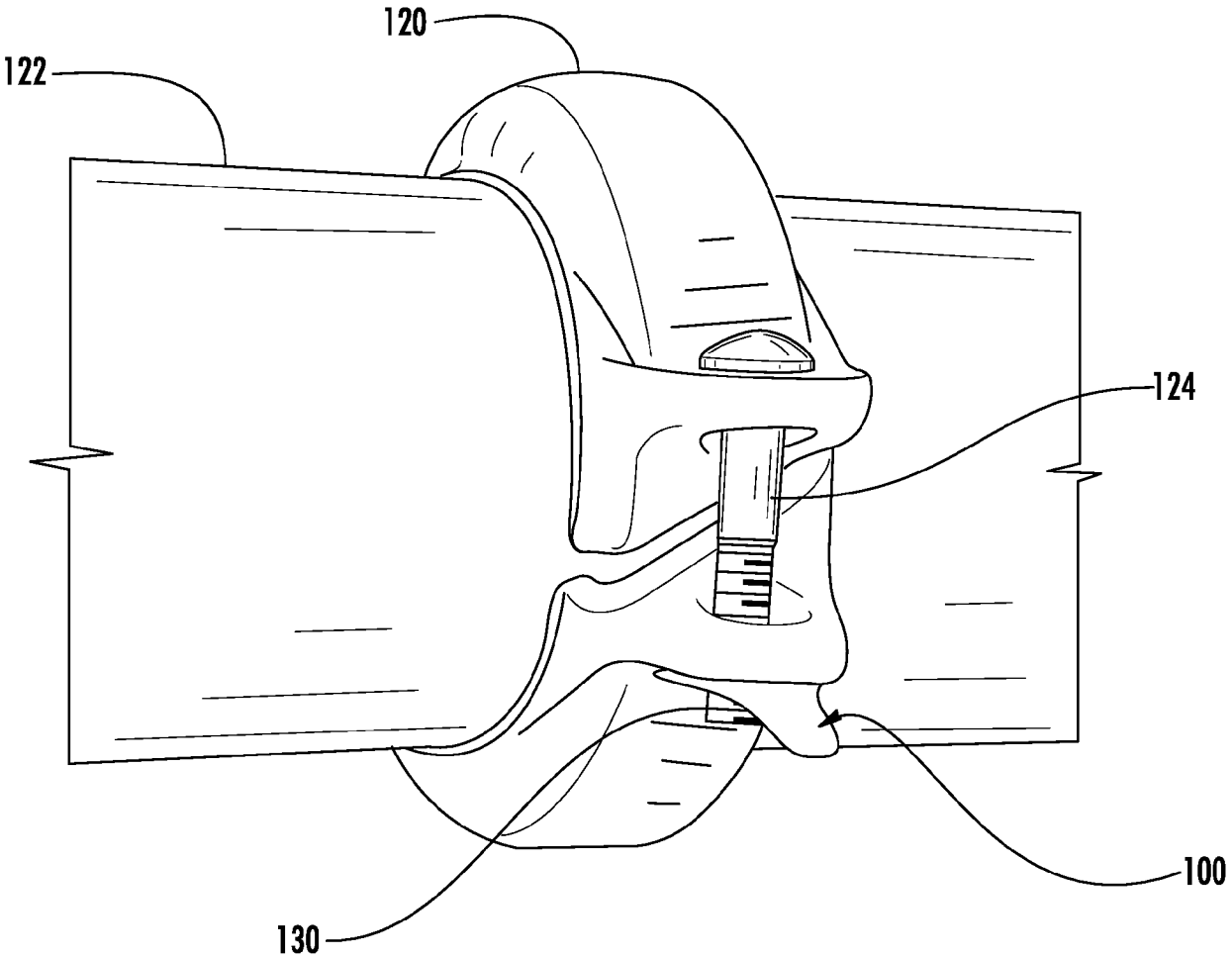
FIG. 4 is a perspective view of the alternative embodiment securely holding the threaded end of a bolt in a pipe coupling.

Referring now to FIGS. 3 and 4, in an alternative embodiment 100, the tool of the present invention is configured to be a disposable clip that is intended to be left on the pipe section (or fittings) 122 and the pipe coupling 120 after tightening the bolts 124. Accordingly, it is preferable that the alternative embodiment 100 is molded or cut from plastic, although, other materials could be used provided that they have sufficient strength to hold the bolt from the forces of the pipe coupling 120 attempting to open.

The alternative embodiment 100 has a small U-shaped knife portion 112 that has a first thread engaging edge 113*a* and a second thread engaging edge 113*b* the form a notch 118 thereon. The notch 11 slides onto the threaded end 130 of a bolt 124, where the thread engaging edges 113*a*, 113*b* wedge between the threads 130 of the bolt 124. Extending rearward from the knife portion 112 is a handle portion 114 that serves as a grip for the tradesman to hold on to.

Referring to FIG. 4, like the preferred embodiment described above, the alternative embodiment is used in the same manner. However, after finger-tightening the bolts 124 the tradesman does not need to remove the alternative embodiment 100 from the bolt 124, but rather may finish tightening the nuts (not shown) onto the bolts 124. The alternative embodiment 100 may be left on the bolt 124 permanently. Alternatively, the tradesman may remove and reuse the alternative embodiment 100 of the tool of the present invention.

Therefore, it can be seen that the present invention provides a unique solution to the problem of providing a tool to hold a bolt on a pipe coupling in place that frees the tradesman's hands, reduces the likelihood of the tradesman dropping a nut or a bolt, and reduces fatigue and frustration experienced by the tradesman while installing the pipe coupling.

As can be appreciated, although the present invention has been described in detail for use with installing a pipe coupling, the tool of the present invention may be used in a variety of situations to temporarily restrain a bolt while connecting a nut thereto. Moreover, the present invention may also be used to restrain threaded rods in addition to bolts.

It would be appreciated by those skilled in the art that various changes and modifications can be made to the illustrated embodiments without departing from the spirit of the present invention. All such modifications and changes are intended to be within the scope of the present invention except as limited by the appended claims.

I claim:

1. A method of installing a pipe coupling onto pipes and fittings, comprising the steps of:

providing a tool having a handle; a knife portion extending from the handle, the knife portion having a tip end, the tip end having a first thread engaging edge, and a second thread engaging edge;

placing the pipe coupling onto the pipes and fittings, the pipe coupling having a first set of flanges and a second set of flanges, each set of flanges having an aperture therethrough for receiving a bolt;

installing a first bolt having a threaded end into the aperture on the first set of flanges and loosely connecting a first nut onto the threaded end of the first bolt;

squeezing the second set of flanges of the pipe coupling together;

inserting a second bolt having a threaded end into the aperture on the second set of flanges, wedging the tip end of the tool against the threaded end of the second bolt such that the first thread engaging edge and the second thread engaging edge engage the threads of the second bolt;

releasing the second set of flanges thereby preventing the pipe coupling from springing open and the second bolt from coming out of the aperture on the second set of flanges;

fastening the first nut on the first bolt; and fastening a second nut on the second bolt.

2. The method of claim 1, further comprising the step of: removing the tool from the second bolt.

* * * * *